US008141258B1

(12) United States Patent
Frisch et al.

(10) Patent No.: US 8,141,258 B1
(45) Date of Patent: Mar. 27, 2012

(54) NECK RAZOR

(75) Inventors: Evan Frisch, Mount Laurel, NJ (US); Brian Seidenfrau, Lawrenceville, NJ (US); John Caporaso, Moorestown, NJ (US)

(73) Assignee: Neckblade LLC, Mount Laurel, NJ (US)

( * ) Notice: Subject to any disclaimer, the term of this patent is extended or adjusted under 35 U.S.C. 154(b) by 285 days.

(21) Appl. No.: 12/589,785

(22) Filed: Oct. 28, 2009

Related U.S. Application Data

(60) Provisional application No. 61/197,868, filed on Oct. 31, 2008.

(51) Int. Cl.
*B26B 21/52* (2006.01)

(52) U.S. Cl. ..... 30/526; 30/298

(58) Field of Classification Search ..... 30/50, 291, 30/298, 526, 537; D28/44–48
See application file for complete search history.

(56) References Cited

U.S. PATENT DOCUMENTS

| | | | | | |
|---|---|---|---|---|---|
| 443,178 | A | * | 12/1890 | Jordan | 30/298 |
| 861,422 | A | * | 7/1907 | Astorgis | 30/69 |
| 971,772 | A | * | 10/1910 | Millar | 30/64 |
| 1,378,079 | A | | 5/1921 | Williamson | |
| 1,385,722 | A | | 7/1921 | Sessoms | |
| 1,515,923 | A | * | 11/1924 | Berntson et al. | 30/278 |
| 1,642,311 | A | * | 9/1927 | Richardson | 56/328.1 |
| 2,325,868 | A | | 8/1943 | Morrow | |
| D146,759 | S | * | 5/1947 | Brown | 30/526 |
| 2,534,861 | A | * | 12/1950 | Foltis | 30/47 |
| D162,933 | S | * | 4/1951 | Chambers | D28/46 |
| 3,078,569 | A | * | 2/1963 | Sidney et al. | 30/32 |
| D229,795 | S | * | 1/1974 | Holohan | D28/46 |
| D231,583 | S | * | 4/1974 | Lorenzo | D28/46 |
| 4,459,744 | A | | 7/1984 | Esnard | |
| 4,712,300 | A | * | 12/1987 | Hemmeter | 30/41 |
| 5,199,173 | A | | 4/1993 | Hegemann et al. | |
| 5,659,962 | A | * | 8/1997 | Tagou | 30/279.6 |
| 6,018,877 | A | | 2/2000 | Greene | |
| 6,029,356 | A | | 2/2000 | Sprinkle | |
| D431,095 | S | * | 9/2000 | Hyman | D28/45 |
| 6,112,421 | A | | 9/2000 | Greene | |
| 6,430,814 | B1 | | 8/2002 | Solow | |
| 6,550,148 | B2 | | 4/2003 | Cecil | |
| D484,769 | S | * | 1/2004 | Cheung | D8/98 |

* cited by examiner

*Primary Examiner* — Hwei C Payer
(74) *Attorney, Agent, or Firm* — Norman E. Lehrer

(57) ABSTRACT

A safety neck razor to be used on the back of a person's neck includes a body having a top surface and a bottom surface, the bottom surface being generally flat and having an opening adapted to releasably secure a razor blade therein. Right and left side contoured edges extend upwardly from the bottom surface and an undulating protuberance extends upwardly from the center of the top surface. The protuberance has a right and a left side with a first well formed between the right side of the protuberance and the right side contoured edge and a second well formed between the left side of the protuberance and the left side contoured edge. The protuberance fits between the fingers of a person's hand and is gripped by the person's fingers so that the fingers rest completely within a respective well.

5 Claims, 3 Drawing Sheets

NECK RAZOR

CROSS REFERENCE TO RELATED APPLICATIONS

This application claims the benefit of prior U.S. Provisional Application Ser. No. 61/197,868, filed Oct. 31, 2008.

BACKGROUND OF THE INVENTION

The present invention is directed toward a razor and more particularly, toward a razor that may be used safely and easily on the back of a person's neck.

Typically, a razor used to shave hair from a person's face or body includes an elongated handle with one or more blades held in place in the head of the handle. The blades are substantially encased by the head so that the risk of accidentally cutting oneself while handling the razor is minimized. This type of razor is used to shave hair off of various areas of a person's body.

Improvements have been made to provide a better grip on the razor, to facilitate better access to areas of the body that are difficult to reach, as well as to improve the safe use of the razor. For example, the head and/or the handle of a razor may be contoured so that the blades function more efficiently. The handle of a razor may be made to be more ergonomically correct.

U.S. Pat. No. 6,550,148 to Cecil discloses a shaving razor with blades supported by a horizontally arranged handle located behind the blades. The device may be held between a person's middle and index fingers and may be used by a person to shave the back of his or her own neck. This device, however, may not give a person using the razor the assurance that he or she has proper control of the razor as it is held between the fingers. Also, the person's finger tips may hinder shaving as they hang over the edge of the razor.

Therefore, a need exists for a razor that is easy to handle, safe to use, and provides access to various areas of a person's body that are difficult to reach by him or herself.

SUMMARY OF THE INVENTION

The present invention is designed to overcome the deficiencies of the prior art discussed above. It is an object of the present invention to provide a razor that is easy and safe to use on the back of a person's neck.

It is another object of the present invention to provide razor that is ergonomically designed so that it may be easily used by a person to shave the back of his or her own neck.

In accordance with the illustrative embodiments demonstrating features and advantages of the present invention, there is provided a razor to be used on the back of a person's neck that includes a body having a top surface and a bottom surface, the bottom surface being generally flat and having an opening adapted to secure a razor blade therein. The bottom surface has upwardly extending right and left side contoured edges. An undulating protuberance extends upwardly from the center of the top surface. The protuberance has a right and a left side with a first well formed between the right side of the protuberance and the right side contoured edge and a second well formed between the left side of the protuberance and the left side contoured edge. The protuberance fits between the fingers of a person's hand and is gripped by the person's fingers so that the fingers rest completely within a respective well. A plurality of apertures extend between the top and bottom surfaces so water or some other cleaning substance may flow therethrough and clean the blade.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
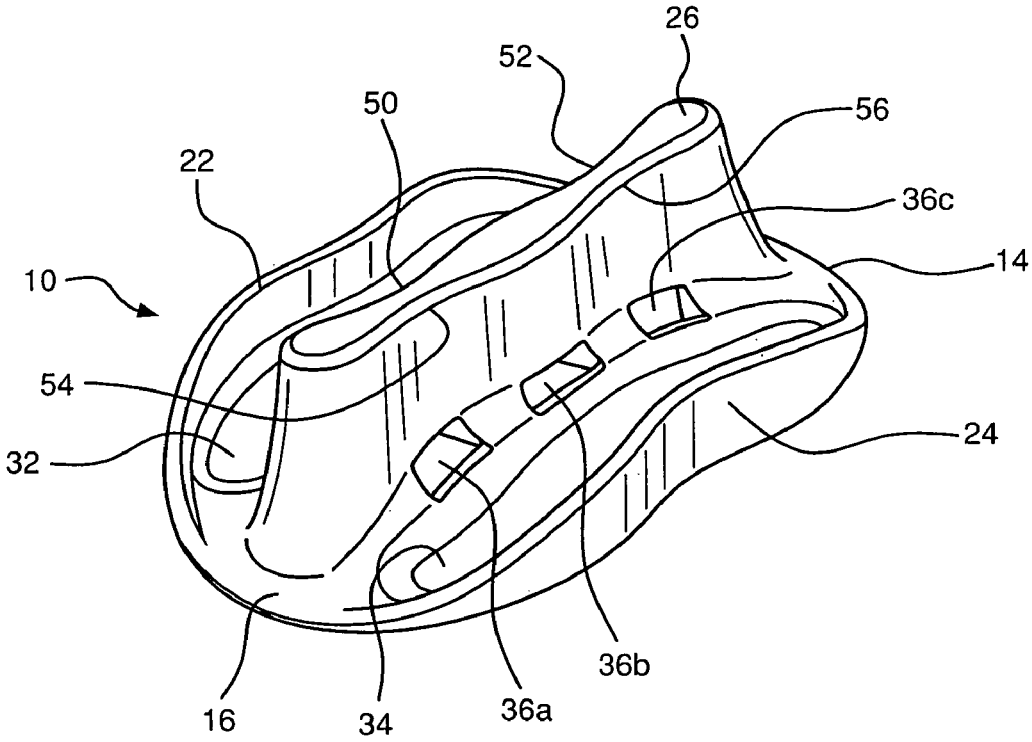
FIG. 1 is a front perspective view of the neck razor of the present invention.

Referring now to the drawings in detail wherein like reference numerals have been used throughout the various figures to designate like elements, there is shown in FIG. 1 a razor constructed in accordance with the principles of the present invention and designated generally as 10.

Figure 3:
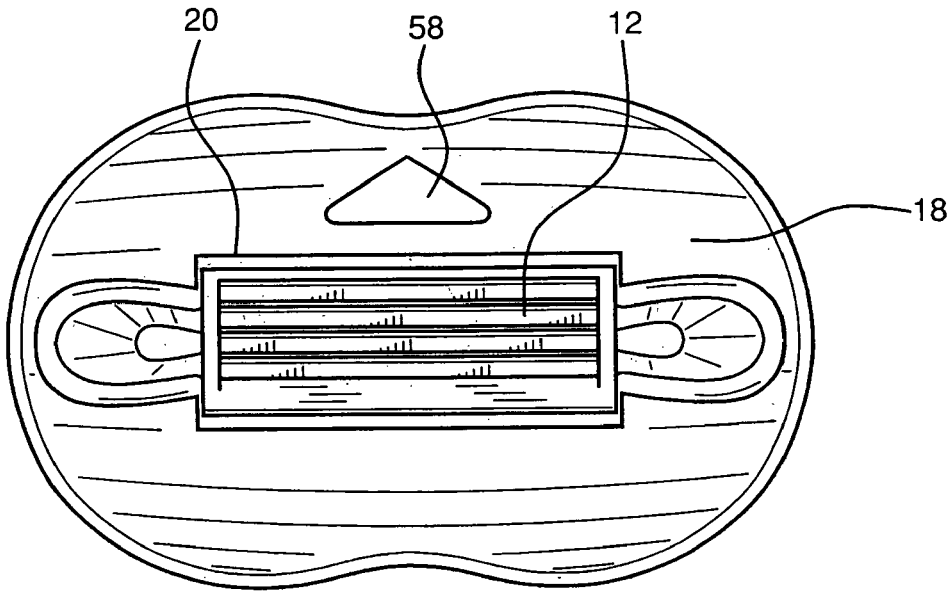
FIG. 3 is a bottom plan view of the present invention.

The razor 10 of the present invention essentially includes a razor blade 12 to be used on the back of a person's neck that is held in a support or body 14 having a top surface 16 and a bottom surface 18. The bottom surface 18 is generally flat and smooth and has a generally elongated opening 20 adapted to secure the razor blade 12 therein. (See FIG. 3.) The blade 12 may be permanently secured whereby the entire device may be disposable or it could be releasably secured within the opening 20 so that the blade 12 may be replaced as often as necessary. The blade 12 is preferably a conventional multi-blade cartridge well known in the art. Accordingly, the details of the same are not believed to be needed. As is also known, a conventional blade 12 is unidirectional in that it cuts or shaves in only one direction.

Figure 2:
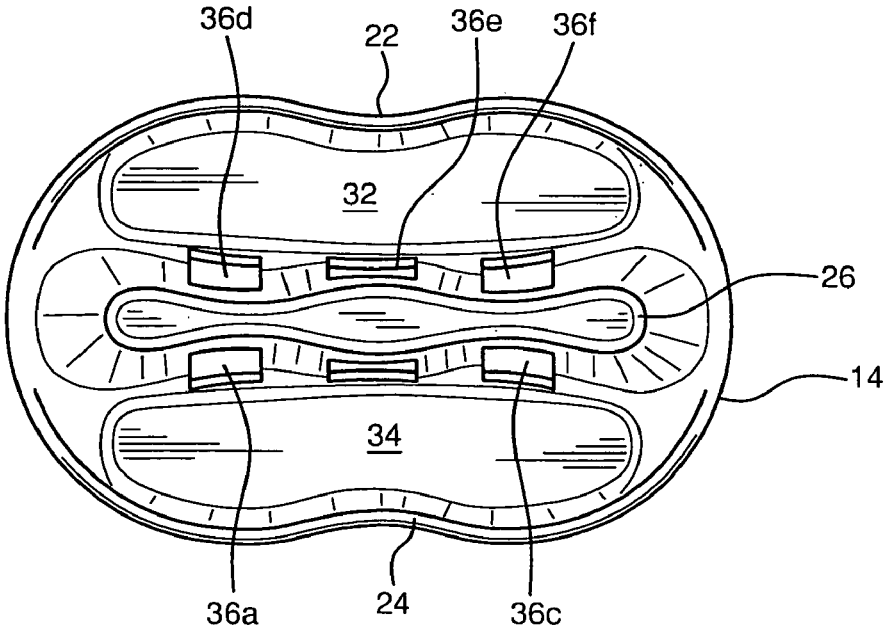
FIG. 2 is a top plan view of the present invention.
Figure 4:
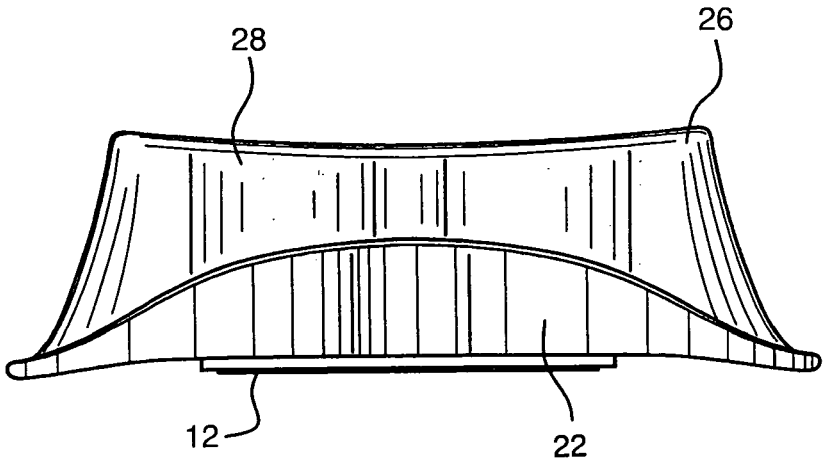
FIG. 4 is a side elevational view of the present invention, the other side being essentially the same.
Figure 5:
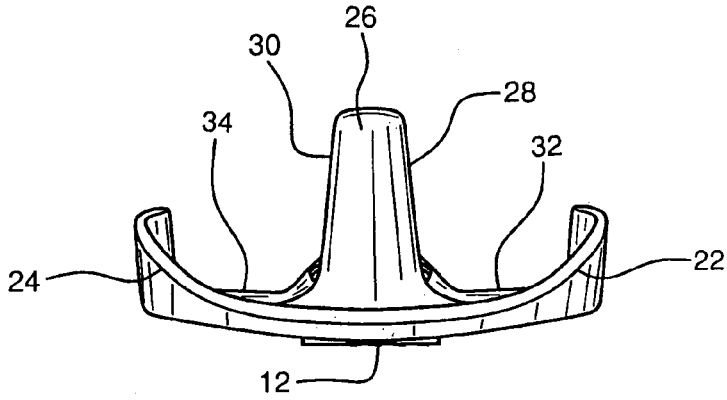
FIG. 5 is an end elevational view of the present invention, the other end being essentially the same.

The bottom surface 18 also has upwardly extending contoured or curved right and left side edges 22 and 24, respectively. (See FIGS. 1 and 4.) An undulating protuberance 26 extends upwardly from the center of the top surface 16 of the body 14. (See FIGS. 1 and 5.) The protuberance 26 has a right side 28 and a left side 30. A first well 32 is formed between the right side 28 of the protuberance 26 and the right side contoured edge 22 and a second well 34 is formed between the left side 30 of the protuberance 26 and the left side contoured edge 24. (See FIG. 2.) A plurality of apertures **36*a*-36*f* are formed in the top surface 16 over the blade 12 so that water or some other cleaning substance may flow therethrough when it is desired to clean the blade 12**.

Figure 6:
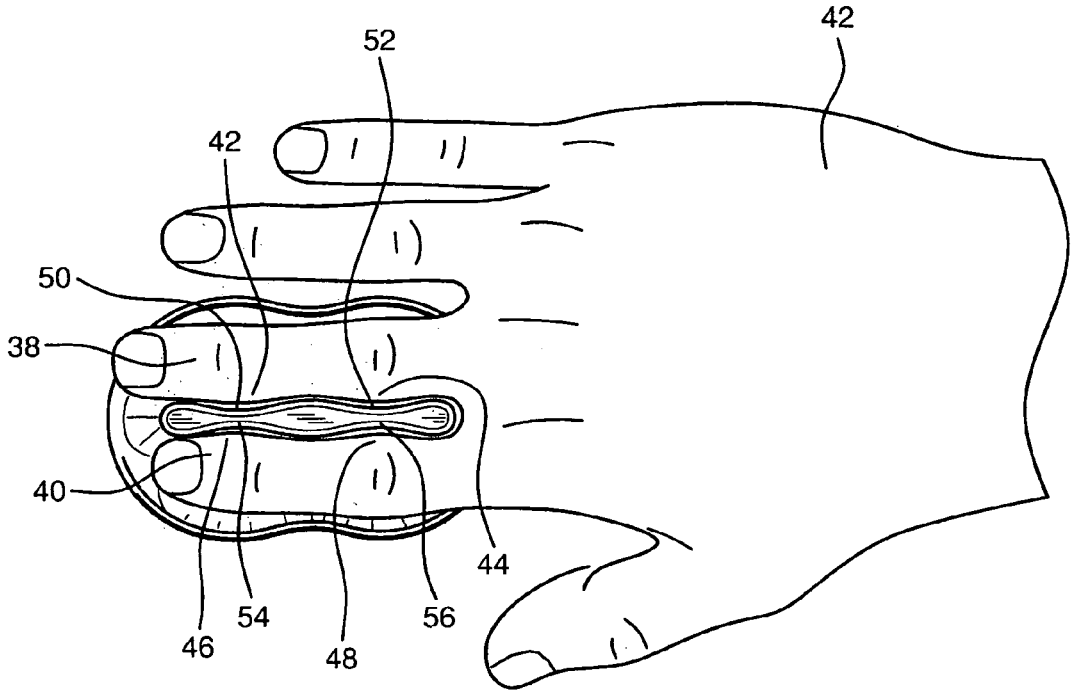
FIG. 6 illustrates the neck razor of the present invention being held in a person's hand.

When using the razor, the protuberance 26 fits between the fingers 38 and 40 of a person's hand 42 and is gripped by the person's fingers so that the fingers, including the finger tips, rest completely within the first and second wells 32 and 34, respectively. (See FIG. 6.) The curved nature of the right and side edges 22 and 24 and the undulating shape of the protuberance 26 allow for the person's fingers to fit comfortably and securely within the device. In this regard, it can be seen that the person's knuckles 42, 44, 46 and 48 fit within the recesses 50, 52, 54 and 56, respectively, formed in the side walls of the protuberance 26. The fingers rest completely within the wells 32 and 34 and do not extend beyond the sides of the body 14 of the device. As a result, the fingers do not contact the person's skin.

As pointed out above, the razor may be used in one direction only. For this reason, an arrow 58 is formed in the top surface 16 to ensure that the user is holding the device in the proper direction which will depend on the direction that the user intends to cut or shave.

The present invention may be embodied in other specific forms without departing from the spirit or essential attributes thereof and accordingly, reference should be made to the appended claims rather than to the foregoing specification as indicating the scope of the invention.

We claim:

1. A safety neck razor comprising:

a body having a top surface and a bottom surface, said bottom surface being generally flat and having an opening adapted to secure a razor blade therein, said bottom surface having right and left side contoured edges extending upwardly from said bottom surface, and an undulating protuberance extending upwardly from the center of said top surface, said protuberance having a right side and a left side, a first well formed between said right side of said protuberance and said right side contoured edge, and a second well formed between said left side of said protuberance and said left side contoured edge, wherein said protuberance fits between two fingers of a person's hand, said protuberance is gripped by the person's fingers, and each of the fingers rests completely within a respective one of said wells.

2. The safety neck razor of claim 1 further including a plurality of apertures formed in said top surfaces in the vicinity of said blade.

3. The safety neck razor of claim 1 wherein said razor blade is part of a multi-blade cartridge.

4. The safety neck razor of claim 3 wherein said cartridge is adapted to cut in only one direction.

5. The safety neck razor of claim 4 wherein said body has indicia thereon indicating the direction in which the neck razor should be moved for it to shave properly.

* * * * *